US009596974B1

(12) United States Patent
Dries

(10) Patent No.: US 9,596,974 B1
(45) Date of Patent: Mar. 21, 2017

(54) FLUID CIRCULATION SYSTEM FOR DISHWASHER APPLIANCES

(71) Applicant: General Electric Company, Schenectady, NY (US)

(72) Inventor: John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 14/860,798

(22) Filed: Sep. 22, 2015

(51) Int. Cl.
*A47L 15/42* (2006.01)
*A47L 15/22* (2006.01)

(52) U.S. Cl.
CPC ..... *A47L 15/4208* (2013.01); *A47L 15/22* (2013.01); *A47L 15/4206* (2013.01)

(58) Field of Classification Search
CPC ..... A47L 15/0039
See application file for complete search history.

(56) References Cited

U.S. PATENT DOCUMENTS 3,646,948 A * 3/1972 Athey ..... A47L 15/4217 134/186
4,038,103 A 7/1977 Grunewald
6,782,899 B2 * 8/2004 Kim ..... A47L 15/4208 134/104.1
2006/0237050 A1 10/2006 Weaver et al.
2014/0109938 A1 4/2014 Geda et al.

FOREIGN PATENT DOCUMENTS

EP 2165637 A2 3/2010

* cited by examiner

*Primary Examiner* — Jason Ko
(74) *Attorney, Agent, or Firm* — Dority & Manning, P.A.

(57) ABSTRACT

Fluid circulation systems for dishwasher appliances are provided. A dishwasher appliance includes a tub that defines a wash chamber. A fluid circulation system includes a sump for receiving fluid from the wash chamber. The sump includes a chamber having a sidewall and a base wall. The fluid circulation system further includes a pump, the pump including an impeller disposed within the chamber. The fluid circulation system further includes a filter at least partially disposed within the chamber and surrounding the impeller, the filter including a sidewall, the sidewall defining a plurality of perforations extending therethrough. The fluid circulation system further includes a shelf cantilevered from the sidewall of the sump towards the filter.

20 Claims, 4 Drawing Sheets

FLUID CIRCULATION SYSTEM FOR DISHWASHER APPLIANCES

FIELD OF THE INVENTION

The subject matter of the present disclosure relates generally to dishwasher appliances, and more particularly to fluid circulation systems with improved filtration in dishwasher appliances.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

Dishwasher appliances further typically include a fluid circulation system which is in fluid communication with the spray assemblies for circulating fluid to the spray assemblies. The fluid circulation system generally receives fluid from the wash chamber, filters soil from the fluid, and flows the filtered fluid to the spray assemblies. Additionally, unfiltered fluid can be flowed to a drain as required.

Some known fluid circulation systems utilize a large, flat, coarse filter and a cylindrical fine filter to filter soil. These filters are generally horizontally positioned within the fluid circulation system, and fluid typically flows through either the coarse or the fine filter as it is flowed towards a pump of the fluid circulation system for recirculation.

More recently, improved filter arrangements have been utilized. These filters have perforated sidewalls which are generally vertically positioned and, for example, cylindrical. A pump is at least partially disposed within such a filter. Generally all wash fluid flowed to the pump is flowed through the filter. Such filter arrangements generally provide improved filtering and fluid flow relative to previously known filter arrangements.

However, some issues remain with such improved filter arrangements. For example, a fundamental issue with filters is that they must remain sufficiently clear to allow fluid to flow therethrough. Excess soil that remains on the filter can block such fluid flow. Accordingly, cleaning of the filter to prevent such blockages during operation is desired. One solution is to actively spray fluid at the filter to remove the soil therefrom. However, this solution requires either that fluid is diverted from the spray assemblies or that significantly more water is utilized during operation of the dishwasher appliance. In either case, the increase in energy and/or water usage decreases the efficiency of the dishwasher appliance and is thus undesirable.

Accordingly, improved fluid circulation systems for dishwasher appliances are desired. In particular, fluid circulation systems which provide improved fluid filtering, and in particular improved filter cleaning during dishwasher appliance operation, would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a fluid circulation system for a dishwasher appliance is provided. The dishwasher appliance includes a tub that defines a wash chamber. The fluid circulation system includes a sump for receiving fluid from the wash chamber. The sump includes a chamber having a sidewall and a base wall. The fluid circulation system further includes a pump, the pump including an impeller disposed within the chamber. The fluid circulation system further includes a filter at least partially disposed within the chamber and surrounding the impeller, the filter including a sidewall, the sidewall defining a plurality of perforations extending therethrough. The fluid circulation system further includes a shelf cantilevered from the sidewall of the sump towards the filter.

In accordance with another embodiment, a dishwasher appliance is provided. The dishwasher appliance includes a cabinet defining an interior, a tub disposed within the interior and defining a wash chamber for the receipt of articles for cleaning, and a fluid circulation system. The fluid circulation system includes a sump for receiving fluid from the wash chamber. The sump includes a chamber having a sidewall and a base wall. The fluid circulation system further includes a pump, the pump including an impeller disposed within the chamber. The fluid circulation system further includes a filter at least partially disposed within the chamber and surrounding the impeller, the filter including a sidewall, the sidewall defining a plurality of perforations extending therethrough. The fluid circulation system further includes a shelf cantilevered from the sidewall of the sump towards the filter.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
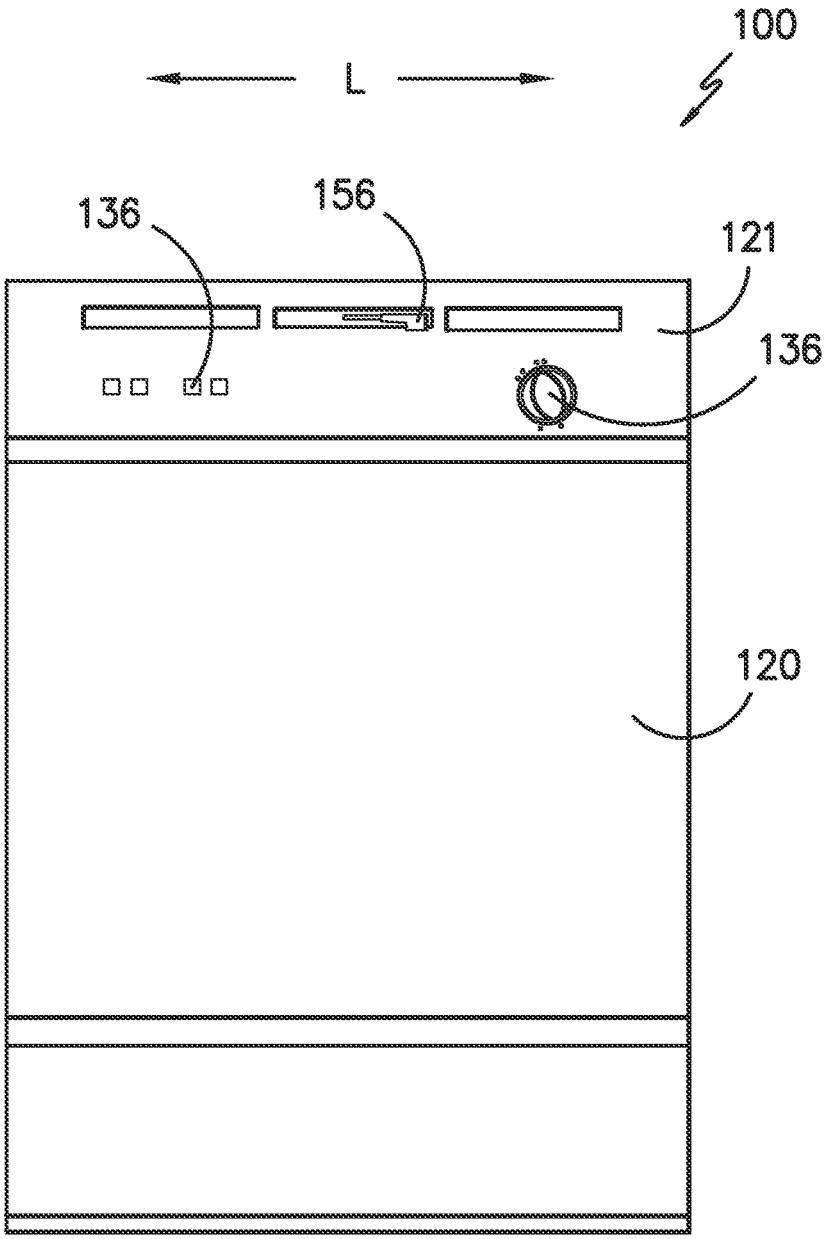
FIG. 1 provides a front view of an exemplary embodiment of a dishwasher appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
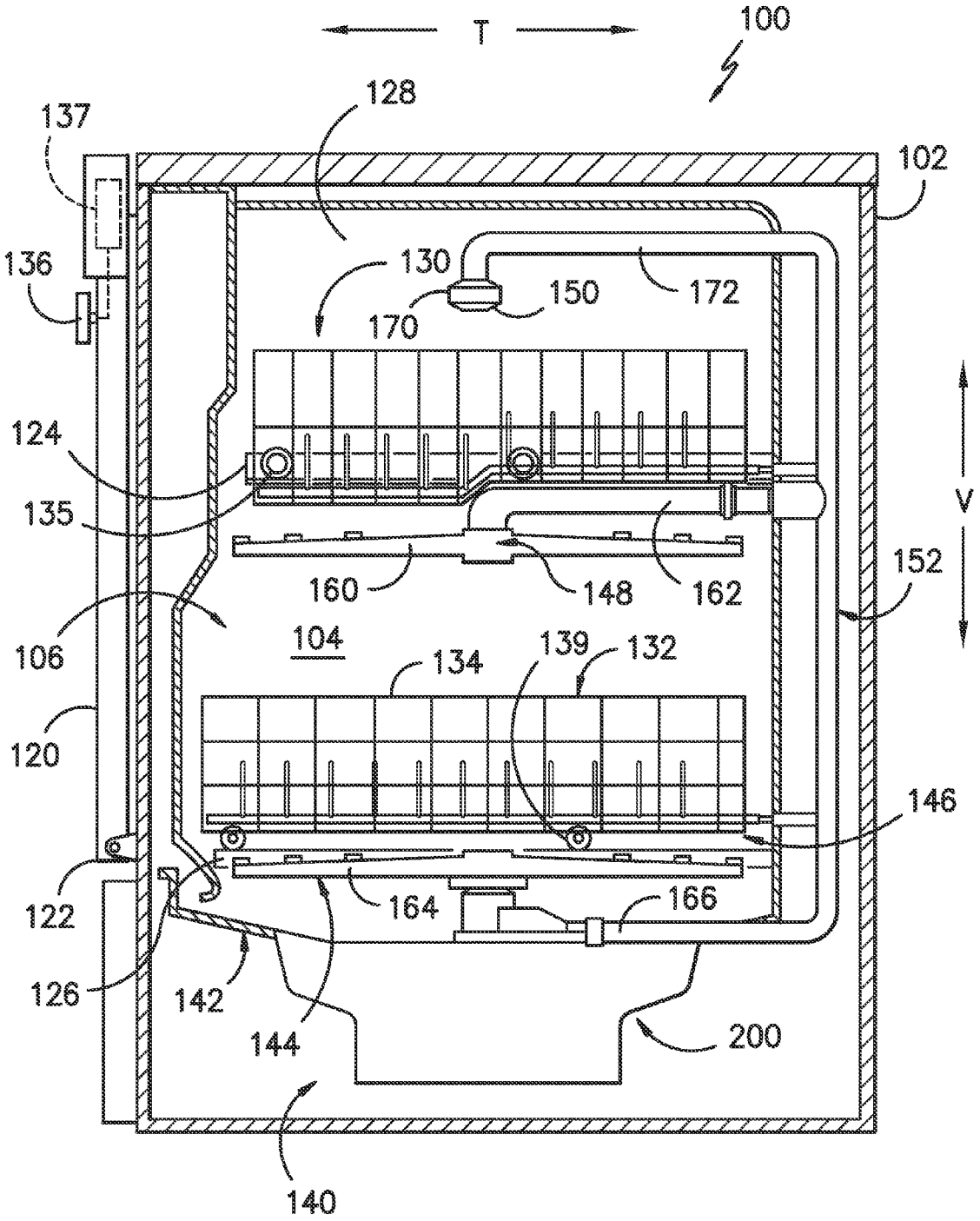
FIG. 2 provides a side, cross-sectional view of the exemplary dishwasher appliance of FIG. 1.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, the dishwasher appliance 100 (such as the cabinet 102 thereof) defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 156 may be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray arm-assembly 144 may include a spray arm and a conduit in fluid communication with the spray arm, for providing a fluid flow to the spray arm. For example, mid-level spray-arm assembly 148 may include a spray arm 160 and a conduit 162. Lower spray-arm assembly 144 may include a spray arm 164 and a conduit 166. Additionally, upper spray assembly 150 may include a spray head 170 and a conduit 172 in fluid communication with the spray head 170.

The lower and mid-level spray-arm assemblies 144, 148 and the upper spray assembly 150 are part of a fluid circulation system 152 for circulating fluid in the dishwasher appliance 100. The fluid circulation system 152 also includes various components for receiving fluid from the wash chamber 106, filtering the fluid, and flowing the fluid to the various spray assemblies such as the lower and mid-level spray-arm assemblies 144, 148 and the upper spray assembly 150. As discussed herein such components can be generally positioned within a machinery compartment 140 below the bottom wall 142 and in communication with the wash chamber 106.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

Figure 3:
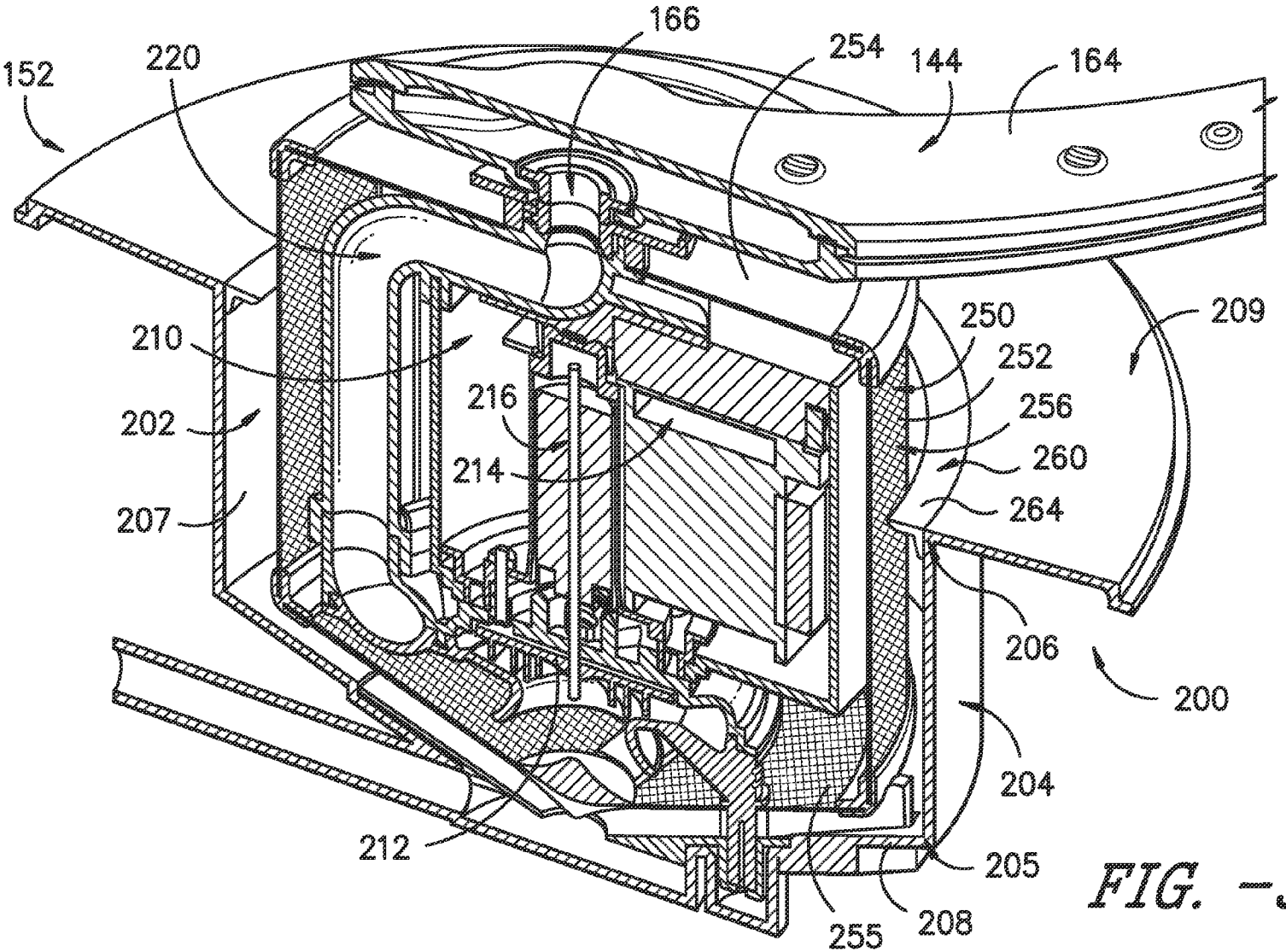
FIG. 3 provides a perspective cross-sectional view of a fluid circulation system for a dishwasher appliance in accordance with one embodiment of the present disclosure.
Figure 4:
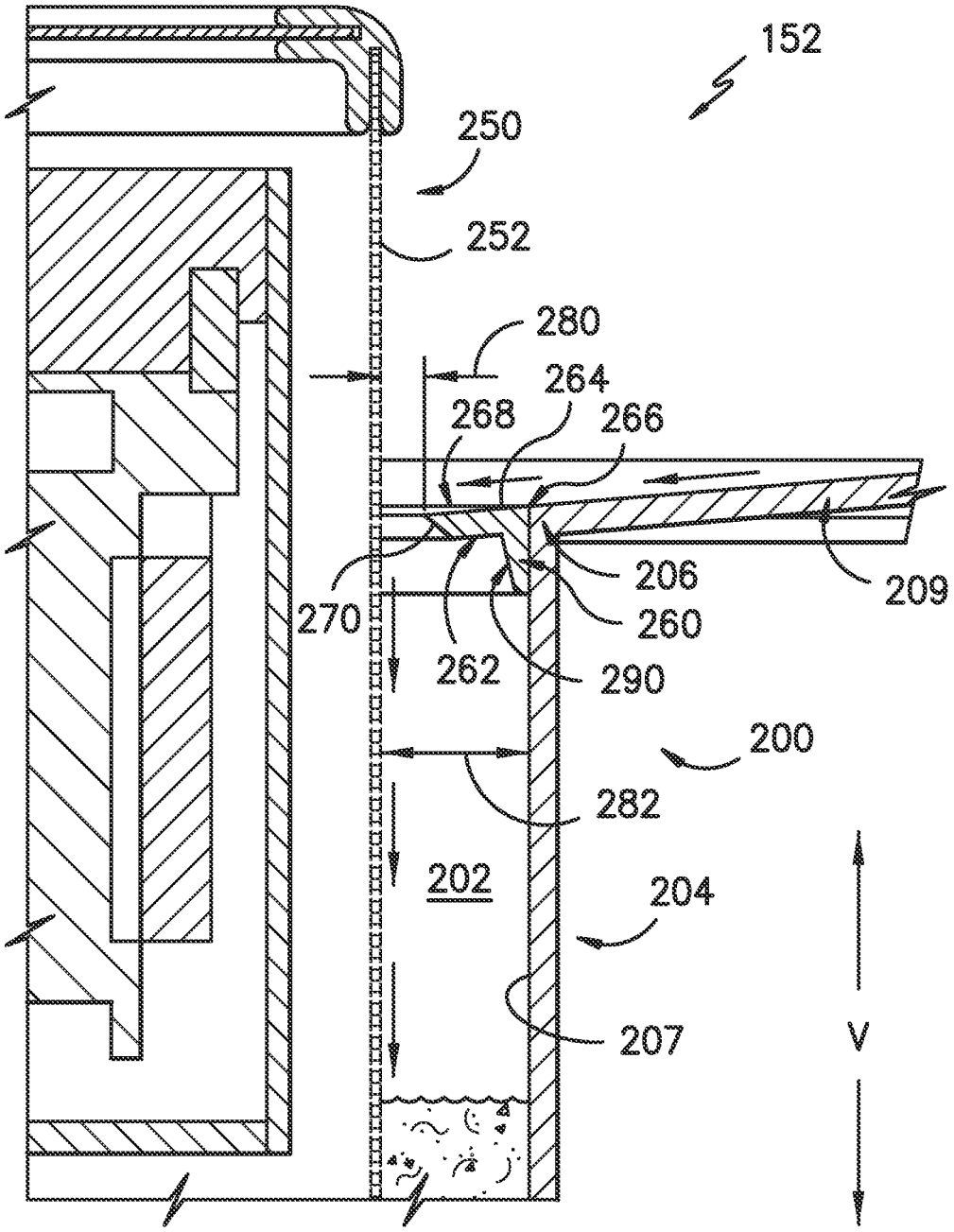
FIG. 4 is a front cross-sectional view of a portion of a fluid circulation system for a dishwasher appliance in accordance with one embodiment of the present disclosure.

Referring now to FIGS. 3 and 4, embodiments of portions of the fluid circulation system 152 of a dishwasher appliance 100 are illustrated. As shown, system 152 may include, for example, a sump 200 for receiving fluid from the wash chamber 106. The sump 200 may be mounted to the bottom wall 142 and extend into the machinery compartment 140, and fluid may for example flow from the bottom wall 142 into the sump 200.

Sump 200 may include and define, for example, a chamber 202 which receives the fluid from the wash chamber 106. As illustrated, sump 200 may include a sidewall 204 and a base wall 208 which define the chamber 202. For example, an inner surface 207 of the sidewall 204 may defined the chamber 202. The sidewall 204 may extend from the base wall 208, such as generally along the vertical direction V (i.e. within 10 degrees of vertical). In some embodiments, the sidewall 204 may have a generally circular cross-sectional shape, as illustrated in FIG. 3. Alternatively, the sidewall 204 may have a generally rectangular or other suitable polygonal cross-sectional shape, with multiple linear or curvilinear cross-sectional portions. Sidewall 204 may extend between a bottom end 205 (which may be connected to the base wall 208) and a top end 206 (which may be distal from the base wall 208 along the vertical direction V).

Sump 200 may additionally include a skirt 209. The skirt 209 may extend from the sidewall 204, such as from the top end 206, away from the chamber 202 and away from a filter 250 disposed at least partially within the chamber 202 (as discussed herein). For example, the skirt 209 may extend generally perpendicularly (i.e. within 10 degrees of radial) to sidewall 204 and/or generally radially (i.e. within 10 degrees of radial) from the sidewall 204. Fluid flowing into the chamber 202 may flow along skirt 209 until the skirt 209 reaches the sidewall 204, and the fluid may then flow into the chamber 202. Skirt 209 may, for example, be mounted to bottom wall 142.

System 152 may further include a pump 210. Pump 210 may include an impeller 212 which is disposed within the chamber 202. Pump 210 may further include a motor 214 and a shaft 216 which connects the motor 214 and impeller 212. For example, the motor 214 may be disposed within the chamber 202, and may be hermetically sealed to prevent damage thereto from fluids within the chamber 202. Alternatively, the shaft 216 may extend through the base wall 208, and the motor 214 may be external to the chamber 202. Impeller 212 may spin within the chamber 202 when activated by the motor 214 to influence the flow of fluid within the chamber 202.

System 152 may further include one or more outlet conduits 220. An outlet conduit 220 flows fluid from the sump 200, such as from the chamber 202 thereof, to the wash chamber 106. For example, outlet conduit 220 may be connected to and in fluid communication with one or more of the various spray assemblies, such as the lower and mid-level spray-arm assemblies 144, 148 and the upper spray assembly 150, such that fluid flowed into the outlet conduit 220 can flow to these spray assemblies. Valves (not shown) disposed within the outlet conduit 220 or other conduits in the system 152 may selectively direct the flow of fluid from the outlet conduit 220 as required. Outlet conduit 220 may be in fluid communication with the pump 210, such that flow flowed through the impeller 212 flows into the outlet conduit(s) 220 towards, for example, the spray assemblies, drain assembly, etc. In the embodiment illustrated, for example, conduit 220 is in fluid communication at least with lower spray arm assembly 144.

As further illustrated, filter 250 may disposed at least partially within the chamber 202. As shown, the filter 250 surrounds the impeller 212, and can additionally surround other components of the pump 210 such as the motor 214. As illustrated, a filter 250 in accordance with the present disclosure may include a sidewall 252. Filter 250 may further include a top wall 254, through which the outlet conduit 220 extends. Still further, filter 250 may include a base wall 255. The sidewall 252 may extend generally along the vertical direction V (i.e. within 10 degrees of vertical) and between the top wall 254 and bottom wall 255. In some embodiments, the sidewall 252 may have a generally circular cross-sectional shape, as illustrated in FIG. 3. Alternatively, the sidewall 252 may have a generally rectangular or other suitable polygonal cross-sectional shape, with multiple linear or curvilinear cross-sectional portions.

As further illustrated, the sidewall 252 may define a plurality of perforations 256 extending therethrough. The perforations 256 may be sized and shaped to allow fluid flow therethrough, while preventing the flow of soil therethrough, thus filtering the fluid as it flows into the filter 250 through the walls thereof. Each perforation 256 may have any suitable shape, such as a generally circular cross-sectional shape, a generally rectangular cross-sectional shape, or other suitable polygonal cross-sectional shape.

Referring still to FIGS. 3 and 4, a shelf 260 may be provided in the fluid circulation system 152. Shelf 260 may advantageously facilitate cleaning of the filter 250, and specifically the sidewall 252 of the filter 250. In particular, fluid flowing into the chamber 202 may, before entering the chamber 202, be flowed over the shelf 260. The shelf 260 may advantageously be disposed proximate the sidewall 252 relative to the sidewall 204, and the fluid may thus be flowed relatively closer to the sidewall 252 before flowing from the shelf 260 into the chamber 202. Accordingly, the fluid may, after flowing from the shelf 260, contact the sidewall 252 and flow down the sidewall 252 into the chamber 202. Soil disposed on the sidewall 252 may advantageously be washed from the sidewall 252 due to this flow of fluid along the sidewall 252. The present inventors have discovered that providing a shelf 260 which results in a reduced gap between the shelf 260 and the sidewall 252, desirably within a particular range and as discussed herein, thus advantageously provide improved filter 250 operation. Notably, such filter cleaning and improved filter operation are advantageously done passively by the existing fluid flow, thus not causing any increases in energy or water usage by the dishwasher appliance during operation.

As illustrated, shelf 260 is cantilevered from the sidewall 204, such as from the inner surface 207 thereof, towards the filter 250. In exemplary embodiments, shelf 260 is cantilevered from the top end 206 of the sidewall 204. For example, an upper surface 264 of the shelf 260 may be flush with an upper surface of the skirt 209, as illustrated. Shelf 260 may, for example, generally conform to and extend from the inner surface 207, and may have an outer cross-sectional shape that corresponds to the inner cross-sectional shape of the sidewall 204. Accordingly, in exemplary embodiments, shelf 260 may have a generally circular cross-sectional shape (and thus be ring shaped), as illustrated in FIG. 3. Alternatively, the shelf 260 may have a generally rectangular or other suitable polygonal cross-sectional shape, with multiple linear or curvilinear cross-sectional portions.

It should be noted that shelf 260 may be a continuous shelf 260, as illustrated, or may be formed from a plurality of sections that together form the shelf 260.

Shelf 260 may, for example, include a ledge 262. Ledge 262 may include the upper surface 264, and may further extend between a first end 266 and a second end 268, such as generally perpendicularly to sidewall 204 and/or generally radially from sidewall 204. The first end 266 may contact the sidewall 204, such as the inner surface 207 thereof. The second end 268 may be spaced from the sidewall 204, and may thus be proximate the filter sidewall 252 relative to the first end 266.

Second end 268 may further include and define an edge 270 of the ledge 262, as illustrated. Notably, in exemplary embodiments, the edge 270 may be a beveled edge as shown. The bevel may, for example, be away from the upper surface 264 towards the first end 266. Such bevel may facilitate the release of fluid from the ledge 262 such that the fluid flows from the ledge 262 and contacts the sidewall 252.

As illustrated, a gap 280 may be defined between the sidewall 252 of the filter 250 and the second end 268, such as the edge 270. In particular, gap 280 may be defined between an outer surface of the sidewall 252 and a relatively closest portion of the ledge 262, such as the edge 270 and in particular embodiments the edge 270 at the upper surface 264. The gap 280 may, for example, be defined radially and/or perpendicularly to the sidewall 204, as illustrated. A gap 282 may additionally be defined between the outer surface of the sidewall 252 and the inner surface 207 of the sidewall 204. Gap 282 may similarly be defined radially and/or perpendicularly to the sidewall 204, as illustrated.

In exemplary embodiments as illustrated, the gap 280 is less than the gap 282. Further, gap 280 may, for example, be between 0.06 inches and 0.5 inches, such as between 0.08 inches and 0.3 inches. Such gap 280 sizes may locate fluid flow desirable close to the sidewall 252 as the fluid flows from the ledge 262 onto the sidewall 252, thus advantageously facilitating cleaning of the sidewall 252.

As further illustrated, shelf 260 may include a support member 290. The support member 290 may, as shown, extend from the first end 266, such as generally along the vertical direction V. Support member 290 may further contact the sidewall 204, such as the inner surface 207 thereof. Support member 290 may generally support the first end 266 of the ledge 262. Second end 268 may be cantilevered from the sidewall 204 and support member 290, and thus unsupported, such that the shelf 260 is generally cantilevered from the sidewall 204.

In some embodiments, shelf 260 may be formed as a separate component from the sump 200, and may be connected to the sump 200. For example, a suitable adhesive, mechanical fasteners, or other suitable connecting apparatus or techniques may be utilized to connect the shelf 260 to the sump 200. Alternatively, the shelf 260 may be integral, and thus formed integrally with, the sump 200. Accordingly, the shelf 260 and sump 200 may be monolithic with no seams or junctions therebetween, and may be formed together, i.e. through use of a single, continuous mold or through use of additive manufacturing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A fluid circulation system for a dishwasher appliance, the dishwasher appliance comprising a tub that defines a wash chamber, the fluid circulation system comprising:

a sump for receiving fluid from the wash chamber, the sump comprising a chamber having a sidewall and a base wall;

a pump, the pump comprising an impeller disposed within the chamber; and a filter at least partially disposed within the chamber and surrounding the impeller, the filter comprising a sidewall, the sidewall defining a plurality of perforations extending therethrough; and a shelf cantilevered from the sidewall of the sump towards the filter, wherein the shelf comprises a ledge and a support member, the ledge extending between a first end and a second end, the first end contacting the sidewall, and second end spaced from the sidewall.

2. The fluid circulation system of claim 1, wherein the shelf is cantilevered from a top end of the sidewall of the sump.

3. The fluid circulation system of claim 1, wherein the support member extends from the first end and contacts the sidewall.

4. The fluid circulation system of claim 1, wherein a gap between the second end and the sidewall of the filter is between 0.06 inches and 0.5 inches.

5. The fluid circulation system of claim 1, wherein the gap is between 0.08 inches and 0.3 inches.

6. The fluid circulation system of claim 1 wherein a gap between the second end and the sidewall of the filter is less than a gap between the sidewall of the sump and the sidewall of the filter.

7. The fluid circulation system of claim 1, wherein the shelf further comprises a beveled edge at the second end.

8. The fluid circulation system of claim 1, wherein the shelf is integral with the sump.

9. The fluid circulation system of claim 1, wherein the shelf is a separate component from the sump and is connected to the sump.

10. A dishwasher appliance, comprising:

a cabinet defining an interior;

a tub disposed within the interior and defining a wash chamber for the receipt of articles for cleaning; and a fluid circulation system, the fluid circulation system comprising:

a sump for receiving fluid from the wash chamber, the sump comprising a chamber having a sidewall and a base wall;

a pump, the pump comprising an impeller disposed within the chamber; and a filter at least partially disposed within the chamber and surrounding the impeller, the filter comprising a sidewall, the sidewall defining a plurality of perforations extending therethrough; and a shelf cantilevered from the sidewall of the sump towards the filter, wherein the shelf comprises a ledge and a support member, the ledge extending between a first end and a second end, the first end contacting the sidewall, and second end spaced from the sidewall.

11. The dishwasher appliance of claim 10, wherein the shelf is cantilevered from a top end of the sidewall of the sump.

12. The dishwasher appliance of claim 10, wherein the support member extends from the first end and contacts the sidewall.

13. The dishwasher appliance of claim 10, wherein a gap between the second end and the sidewall of the filter is between 0.06 inches and 0.5 inches.

14. The dishwasher appliance of claim 10, wherein the gap is between 0.08 inches and 0.3 inches.

15. The dishwasher appliance of claim 10, wherein a gap between the second end and the sidewall of the filter is less than a gap between the sidewall of the sump and the sidewall of the filter.

16. The dishwasher appliance of claim 10, wherein the shelf further comprises a beveled edge at the second end.

17. The dishwasher appliance of claim 10, wherein the shelf is integral with the sump.

18. The dishwasher appliance of claim 10, wherein the shelf is a separate component from the sump and is connected to the sump.

19. A fluid circulation system for a dishwasher appliance, the dishwasher appliance comprising a tub that defines a wash chamber, the fluid circulation system comprising:

a sump for receiving fluid from the wash chamber, the sump comprising a chamber having a sidewall and a base wall;

a pump, the pump comprising an impeller disposed within the chamber; and a filter at least partially disposed within the chamber and surrounding the impeller, the filter comprising a sidewall, the sidewall defining a plurality of perforations extending therethrough; and a shelf cantilevered from the sidewall of the sump towards the filter, wherein the shelf comprises a ledge extending between a first end and a second end, the first end contacting the sidewall, the second end spaced from the sidewall, and wherein the shelf further comprises a beveled edge at the second end.

20. The fluid circulation system of claim 19, wherein the shelf is cantilevered from a top end of the sidewall of the sump.

* * * * *